US005492457A

United States Patent [19]

Lee

[11] Patent Number: 5,492,457

[45] Date of Patent: Feb. 20, 1996

[54] UNIDIRECTIONAL FLOW PUMP WITH ROTARY DRIVE

[76] Inventor: W. Ken Lee, 3531 Princeton Corners La., Marietta, Ga. 30062

[21] Appl. No.: 262,980

[22] Filed: Jun. 21, 1994

[51] Int. Cl.[6] ..... F04B 35/00

[52] U.S. Cl. ..... 417/405; 74/22 R; 417/415; 417/440; 417/454; 417/571

[58] Field of Search ..... 417/405, 415, 417/454, 571, 440; 74/22 R

[56] References Cited

U.S. PATENT DOCUMENTS

| | | | |
|---|---|---|---|
| 1,244,160 | 10/1917 | Anderson | 74/22 R |
| 1,694,834 | 12/1928 | Sinclair . | |
| 2,255,852 | 9/1941 | Lundin . | |
| 2,436,493 | 2/1948 | Shepard . | |
| 2,502,279 | 3/1950 | Rood . | |
| 2,674,191 | 4/1954 | Ifield . | |
| 2,711,653 | 6/1955 | Zero . | |
| 3,039,676 | 6/1962 | Mikina . | |
| 3,061,044 | 10/1962 | Shotmeyer . | |
| 3,382,812 | 5/1968 | Smith | 417/415 |
| 3,819,303 | 6/1974 | Pfleger | 417/440 |
| 4,531,897 | 7/1985 | Orlita | 74/22 R |
| 4,597,717 | 7/1986 | Mohr | 417/415 |

FOREIGN PATENT DOCUMENTS 995004 8/1951 France .

*Primary Examiner*—Michael Koczo
*Attorney, Agent, or Firm*—Richard C. Litman

[57] ABSTRACT

A hydraulic pump provides unidirectional fluid flow regardless of the direction of rotation of the rotary shaft of the pump. The rotary shaft is affixed to a rotating arm, which arm includes a spherical bearing in the outer end thereof which secures to the pin of a plunger. The rotary shaft is inclined at an angle to the axis of the plunger, resulting in a reciprocating action of the plunger when the rotary shaft is turned. The pump may be motorized by a variety of different power sources, and preferably includes a speed reduction for such motors in order to allow smaller motors and valve assemblies. The valves are preferably included in an easily removable and replaceable integrated cartridge, thus enabling the pump to be quickly adapted to various types of hydraulic devices, such as jacks, hoists, presses, etc. The valving within the cartridge also includes various features providing for compactness and efficiency. The pump also provides for ease of removal and replacement of a motor used for power, to allow operation of the pump by a hand crank if necessary.

21 Claims, 3 Drawing Sheets

UNIDIRECTIONAL FLOW PUMP WITH ROTARY DRIVE

FIELD OF THE INVENTION

The present invention relates generally to fluid transfer devices, and more specifically to a fluid (i.e., hydraulic) pump providing for movement of fluid in a single direction, independent of the direction of the rotary drive therefor. The pump includes mechanical means for translating the rotary drive motion to reciprocating motion to drive a plunger, as well as other features, and is adaptable to a variety of hydraulic devices and drive means.

1. Background of the Invention

Various hydraulic devices have been developed in the past for the application of force or work to an object. Such devices generally use a hydraulic ram, i.e., a piston being pushed from a cylinder by hydraulic pressure. Many automotive jacks, presses, engine hoists, portable pumps, etc. utilize the above principle, and in the case of relatively light duty and/or portable devices, generally manual power is used to supply the hydraulic pressure to the unit.

Alternatively, many such devices intended for heavier duty and/or for permanent installation, have dedicated power sources providing the required hydraulic pressure to the hydraulic device. Such devices are generally not portable and utilize relatively large electric or other motors or power sources to supply the required pressure. Generally, portable or relatively light duty hydraulic tools are not equipped with automated power sources, which can pose a problem to many users under some circumstances.

The need arises for a relatively small and lightweight automated hydraulic pump for hydraulic devices such as jacks, lifts, presses, and the like, which pump is easily adaptable to such hydraulic tools and equipment. The pump should also be easily adaptable to various types of power supplies, i.e., electrical, pneumatic, and hydraulic motors, to provide power therefor. A speed reduction may provide not only for a smaller and lighter power supply motor, but also for smaller valving due to the relatively lower rate of hydraulic flow, thus serving further to reduce weight and bulk for the device. In addition to the above, the pump should be unidirectional, i.e., providing hydraulic output independently of the direction of rotation of the power source.

2. Description of the Prior Art

U.S. Pat. No. 1,694,834 issued to George W. Sinclair on Dec. 11, 1928 discloses a Mechanism For Transmitting Movement wherein a crank is used to turn an eccentric, which in turn causes a shaft to revolve. The crank may be adjustably angularly offset relative to the rotating shaft, thus causing the shaft to reciprocate in addition to its rotational movement. However, the shaft requires an additional link between the output arm of the crank and the shaft, in order to allow purely axial movement of the shaft. The present pump uses a very loosely similar mechanism, but avoids the requirement for the additional link. Moreover, the Sinclair device does not provide an automated power supply, speed reduction, hydraulic pump means, or valving, as in the present pump.

U.S. Pat. No. 2,255,852 issued to Knut E. Lundin on Sep. 16, 1941 discloses a Pump Assembly comprising a radial multiple cylinder device with reciprocating pistons connected to a crankshaft. No combination of rotary and reciprocating motion of the pistons is possible with this arrangement. The plane of reciprocation of the pistons is perpendicular to the plane of rotation of the crankshaft drive, which in combination with the radial array, results in a relatively bulky assembly, unlike the present pump. No means is disclosed for ease of installation to an existing hydraulic device in order to provide power therefor.

U.S. Pat. No. 2,436,493 issued to Ralph H. Shepard on Feb. 24, 1948 discloses a Mechanical Lubricator in which a rod provides the rotary motion to the pump, rather than being the driven member of the device. An angularly adjustable offset has one end rotationally captured by a slot in the rod and an opposite end captured by an adjustable member. As the rod rotates, the offset member is also forced to rotate and thereby reciprocate due to the offset. The reciprocation of the captured end within the rod provides a pumping action, but the direction of fluid flow or pressure is dependent upon the direction of rotation of the rod, unlike the unidirectional output of the present pump.

U.S. Pat. No. 2,502,279 issued to Alvin A. Rood on Mar. 28, 1950 discloses a Soft-Seat Relief Valve providing certain advantages in seating and cracking (barely opening) pressures. As a radial rather than an axial port is disclosed, no passages are provided through the valve itself which are uncovered as the valve is unseated, as in the valve arrangement of the present invention. The present valve arrangement, with its axial porting, provides a much more compact valve assembly.

U.S. Pat. No. 2,674,191 issued to Richard J. Ifield on Apr. 6, 1954 discloses a Hydraulic Speed Governor For Prime Movers utilizing a spring biased wobble plate or swash plate which works against the spring due to centrifugal force when in operation. Thus, the angle of the swash plate relative to the shaft is variable, unlike the fixed angular relationship of the rotary drive (which is not a swash plate) and plunger of the present invention. Moreover, the fluid flow through the Ifield device is bidirectional, unlike the present invention.

U.S. Pat. No. 2,711,653 issued to Anthony F. Zero on Jun. 28, 1955 discloses a Device For Converting Rotary Movement To Harmonic Movement comprising a shaft having an offset crank which supplies rotary motion to a flexible cable. The output axis of the cable is axially offset relative to the input shaft, which causes the cable to reciprocate within its housing, as well as rotating due to the rotary motion. The variable distance between the end of the crank arm and the offset axis of the cable output is accommodated by the flexible cable, unlike the arrangement of the present invention. Moreover, no drive means, speed reduction means, or valve means are disclosed by the Zero device.

U.S. Pat. No. 3,039,676 issued to Stanley J. Mikina on Jun. 19, 1962 discloses a Motion Converting Apparatus "for converting rotary motion to reciprocating motion along a line parallel . . . to the axis of rotation of the driving element." (column 1, lines 9 through 12 of the Mikina Patent). An angularly pivotable link is used between an eccentrically rotating element and a piston or plunger, somewhat like the Sinclair linkage discussed above. The present invention avoids any requirement for such angular links or flexible cable (Zero) between rotary and reciprocating members.

U.S. Pat. No. 3,061,044 issued to Albert Shotmeyer on Oct. 30, 1962 discloses a Hydraulic Lift designed for ease of installation and removal, but nevertheless being a semi-permanent installation, unlike the present invention. The pump mechanism is not disclosed, other than that it is driven by a reversible electric motor. The present invention does not require any specific direction of rotation for the drive means due to the unidirectional fluid output, thus a reversible motor is not needed.

Finally, French Patent No. 995,004 to Rene Florentin-Poittevin and published on Nov. 26, 1951 discloses a compressor utilizing an angularly variable swash plate to control the reciprocating motion of a rotating shaft captured therein. The driven shaft and plunger are axially concentric, unlike the present invention with its angularly offset drive. Moreover, no speed reduction is disclosed in the Florentin-Poittevin device.

None of the above noted patents, taken either singly or in combination, are seen to disclose the specific arrangement of concepts disclosed by the present invention.

SUMMARY OF THE INVENTION

By the present invention, an improved hydraulic pump is disclosed.

Accordingly, one of the objects of the present invention is to provide an improved hydraulic pump which is adaptable to various types and configurations of power sources (e.g., electric, hydraulic, pneumatic) and to various types and configurations of hydraulic devices (e.g., jacks, presses, hoists) to provide hydraulic pressure therefor.

Another of the objects of the present invention is to provide an improved hydraulic pump which provides unidirectional fluid flow independent of the direction of rotation of the power source.

Yet another of the objects of the present invention is to provide an improved hydraulic pump which includes an angularly displaced rotary drive means and means converting the rotary motion reciprocating motion and obviating any requirement for a movable or flexible intermediate link between the rotary component and the reciprocating component.

Still another of the objects of the present invention is to provide an improved hydraulic pump which includes a separate, enclosed and independently lubricated bearing means connecting the rotary component and reciprocating component of the pump.

A further object of the present invention is to provide an improved hydraulic pump which includes speed reduction means between the output of the power source and the rotary shaft of the pump.

An additional object of the present invention is to provide an improved hydraulic pump which valve means comprises an inlet, an outlet, and a bypass valve within a valve cartridge, which cartridge is quickly and easily removable from and replaceable within another hydraulic device for control of hydraulic fluid thereto and therefrom.

Another object of the present invention is to provide an improved hydraulic pump which valve cartridge may include axially ported ball and/or needle valves, as well as other features.

Yet another object of the present invention is to provide an improved hydraulic pump which may include a pressure relief valve disposed either upstream or downstream of the outlet valve.

Still another object of the present invention is to provide an improved hydraulic pump which power source is easily removable therefrom and which provides for manual crank operation in lieu of automated or motorized operation.

A final object of the present invention is to provide an improved hydraulic pump for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
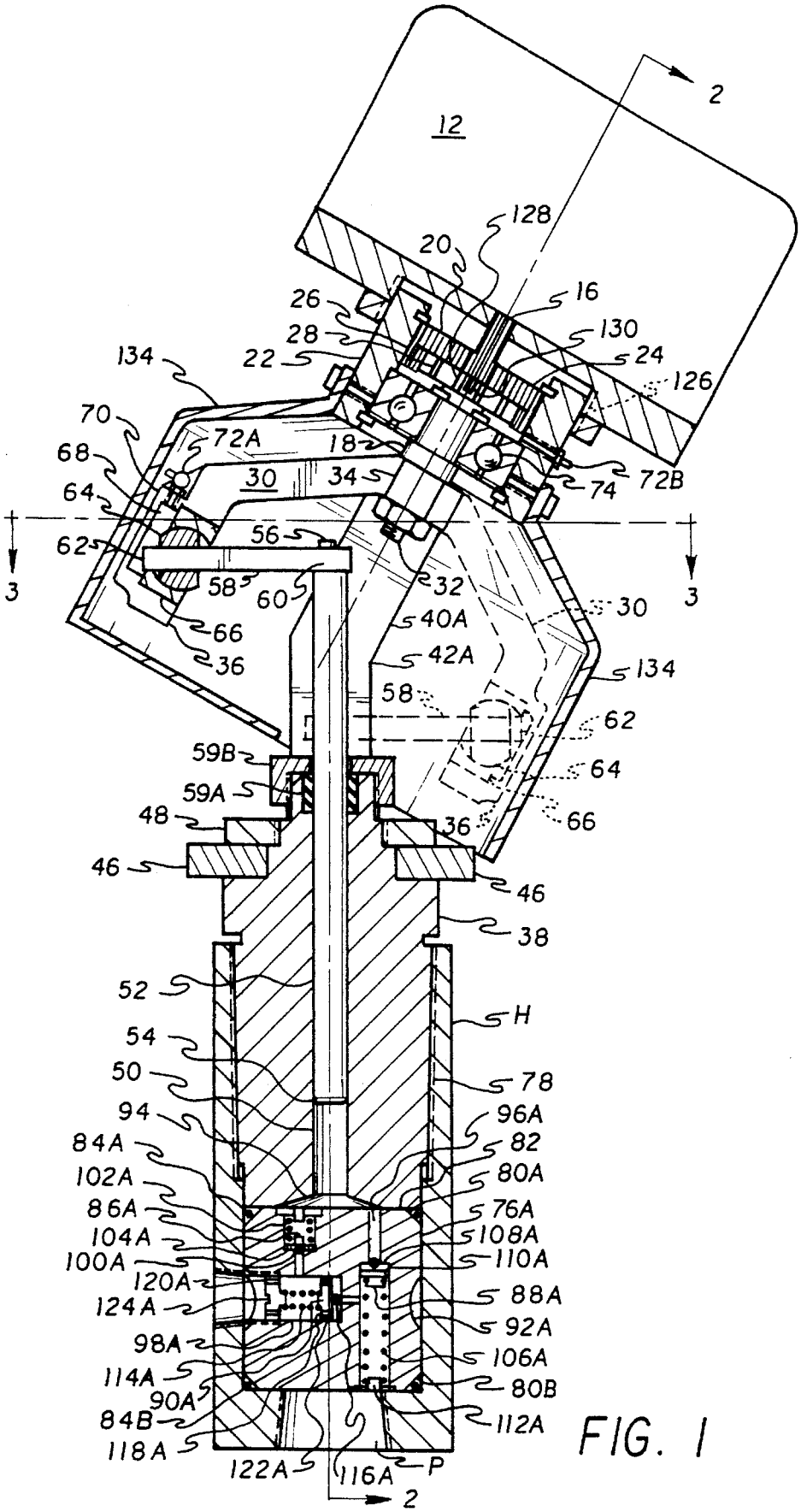
FIG. 1 is a side view in section of the hydraulic pump of the present invention, showing its various components and features.
Figure 2:
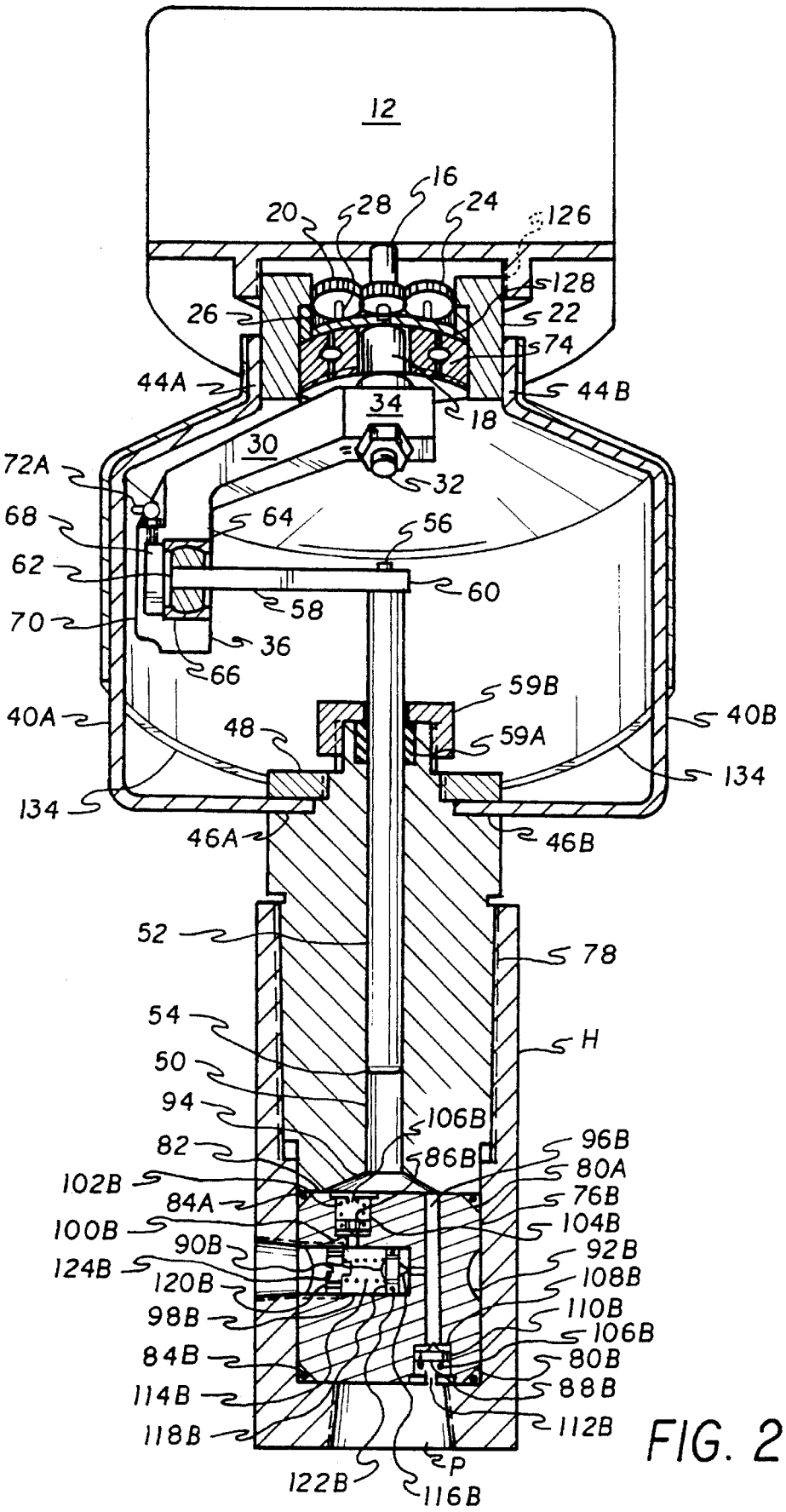
FIG. 2 is a sectional view of the present pump generally along line 2—2 of FIG. 1, 90 degrees to the view of FIG. 1.
Figure 4:
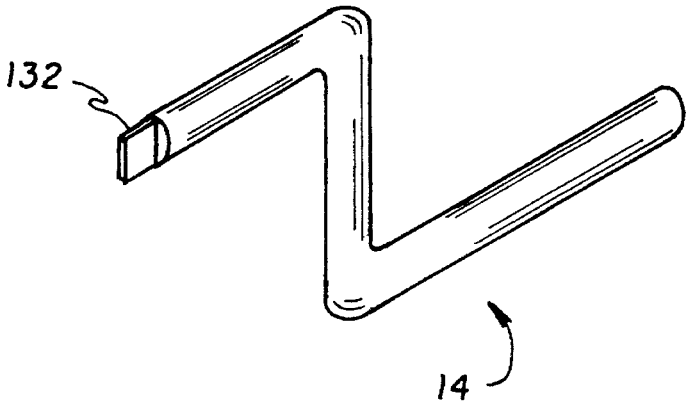
FIG. 4 is a perspective view of a hand crank comprising an alternative manual means of operating the present hydraulic pump.

Referring now particularly to FIGS. 1 and 2 of the drawings, the present invention will be seen to relate to a fluid pump 10 particularly adapted for hydraulic fluid transfer and providing for unidirectional fluid flow, independent of the direction of rotation of the rotary power means used to power the pump 10. Pump 10 may be powered by a motorized power source, such as the electric, hydraulic or pneumatic motor 12 shown generally in FIGS. 1 and 2, or alternatively may be powered by a hand crank 14 shown in FIG. 4, which operation is described further below.

The motorized power source 12 has a drive shaft 16 extending therefrom, which provides rotary power to a rotary output shaft 18, e.g., by a planetary gear reduction drive 20 contained within an output shaft housing 22; other speed reduction means (e.g., spur gears, etc.) may be used alternatively. The central motor drive shaft 16 engages and turns a set of planetary gears 24, which in turn mesh with a fixed ring gear 26 within the stationary output shaft housing 22, thus causing the planetaries 24 to revolve about the inside of the housing 22. The planetaries 24 are affixed to the rotary output shaft 18 by pins 28, thus causing the output shaft 18 to rotate.

The output shaft 18 is in turn affixed to a rotary arm 30, e.g. by means of a threaded rotary arm attachment end 32 and cooperating nut, or other suitable means. The rotary arm 30 extends generally radially between an output shaft attachment end 34, and an opposite plunger pin attachment end 36. The rotary arm 30 is also angled away from the motor 12 and output shaft housing 22, to describe a conic shape during rotation and to provide clearance for other structure, described below.

The output shaft and motor speed reduction housing 22 is angularly affixed to a plunger body 38 by at least two oppositely spaced apart output housing support arms **40*a* and 40*b*. Arms 40*a*/40*b* each include an angular bend 42*a* and 42*b* (42*a* being shown in FIG. 1) between their output shaft housing attachment ends 44*a* and 44*b* (FIG. 2) and opposite plunger body attachment ends 46***a* and 46*b*, which ends 46*a* and 46*b* are captured by an attachment nut 48 and thereby immovably affixed to the plunger body 38. Thus, the rotary axis of the output shaft 18 and the axis of the cylinder bore 50 within the plunger body 38 are not parallel, but form an angle relative to one another. With the output shaft housing attachment ends 44*a*/44*b* of the support arms 40*a*/40*b* immovably affixed to the output shaft housing 22, and the opposite plunger body attachment ends 46*a*/46*b* immovably affixed to the plunger body 38, it will be seen that the output shaft housing 22 is also immovably affixed to and held stationary relative to the plunger body 38.

A plunger 52 is provided which both reciprocates and rotates within the plunger body cylinder bore 50. The plunger 52 includes a fluid working end 54 which operates to change the volume within the plunger body cylinder bore 50 to transfer fluid therefrom through plural valves discussed further below, and an opposite plunger pin attachment end 56 which is affixed to a plunger pin 58. Packing 59*a* and a gland nut 59*b* may be provided to seal the plunger 52. The plunger pin 58 includes a plunger attachment end 60 affixed to the plunger 52 at the plunger pin attachment end 56 thereof, and an opposite rotary arm attachment end 62 which rides within a spherical bearing means 64. The spherical bearing 64 is in turn captured within a bearing housing 66 located within the plunger pin attachment end 36 of the rotary arm 30.

The present pump operates by applying rotary power to the rotary output shaft 18, which shaft 18 causes the rotary arm 30 affixed thereto to rotate. As the rotary axis of the arm 30 is angularly displaced relative to the axis of the plunger 52, it will be seen that as the arm 30 rotates, the arcuate path described by the outboard or plunger pin attachment end 36 of the rotary arm 30 will have one side relatively higher than the other, when viewed from the side as in FIG. 1. The result of this path of travel of the outboard end 36 of the arm 30 will be to cause the plunger pin 58, and thus the plunger 52 to which it is affixed, to not only rotate about the axis of the plunger body 38, but also to reciprocate upwardly and downwardly relative to the plunger body 38, thus causing the plunger 52 to reciprocate within the plunger cylinder bore 50. It will be seen that the above described reciprocating action is not affected by the direction of rotation of the output shaft 18; no matter in which direction the output shaft 18 is rotated, the above reciprocating action will occur. Flow of fluid is controlled by valves within a valve body (described further below), which valves operate independently of the above described rotating and reciprocating action.

Figure 3:
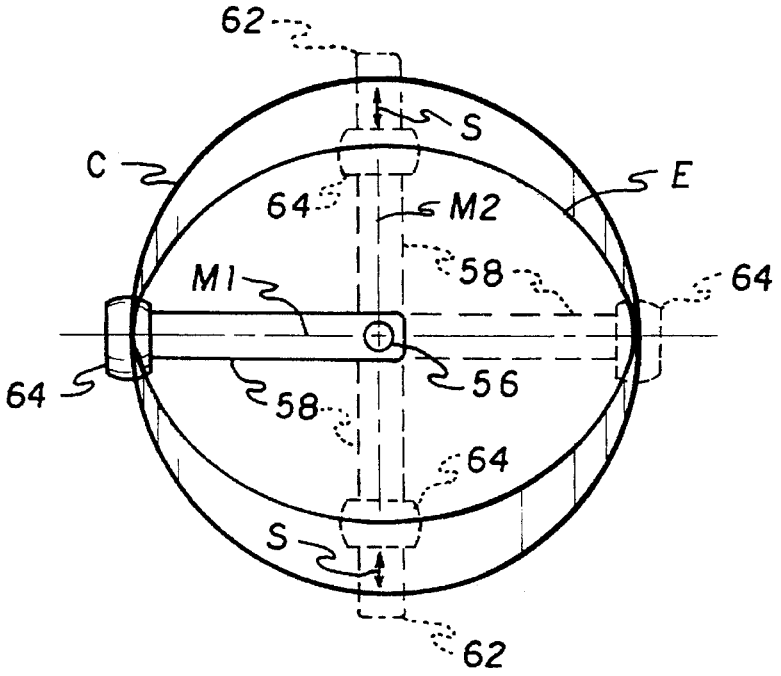
FIG. 3 is a simplified sectional view along line 3—3 of FIG. 1, showing the operation of the connection between the rotating and reciprocating components.

While the outboard/plunger pin attachment end 36 of the rotary arm 30 describes a circular path relative to the rotary axis of the output shaft 18, it will be seen that, due to the angular inclination of the circular path relative to the reciprocating axis of the plunger 52, the path of the outboard end 36 of the arm 30 will appear to describe an ellipse relative to the axis of the plunger 52; this is schematically shown in FIG. 3, as viewed looking downwardly along the axis of the plunger 52.

While the outboard end 62 of the plunger pin 58 describes a circular path C due to the fixed length of the pin 58, as shown in FIG. 3, the inclination of the axis of the output shaft 18 relative thereto will cause the outboard end 36 of the rotary arm 30 (and therefore the spherical bearing 64 captured therein) will describe an ellipse E, having a major axis M1 and a minor axis M2, relative to the axis of the plunger 52. While the major axis M1 of the ellipse is equal to the diameter of the circle C, the minor axis M2 is considerably shorter, due to the elliptical path traveled by the outboard end 36 of the rotary arm 30 and bearing 64, relative to the outboard end 62 of the plunger pin 58. Since the outboard or rotary arm attachment end 62 of the plunger pin 58 is captured within the outboard or plunger pin attachment end 36 of the rotary arm 30, means must be provided to allow for the change in diameter of the path traveled by the spherical bearing 64 relative to the length of the plunger pin 58.

This is accomplished by allowing the spherical bearing 64 to slide longitudinally along the length of the plunger pin 58 between the diameter of the circle C and the minor axis M2 of the ellipse E, as shown by the bearing movement arrows S in FIG. 3. The bearing 64 is free to rotate spherically within the bearing housing 66, while simultaneously sliding back and forth twice per revolution along the outboard end 62 of the plunger pin 58. Thus, all relative movement between the rotary output shaft 18 and the plunger 52, is accommodated at a single joint comprising the outboard or rotary arm attachment end 62 of the plunger pin 58 and the outboard or plunger pin attachment end 36 of the rotary arm 30. All other joints in the above described apparatus are immovably affixed to one another.

As the only relative motion in the above rotating and reciprocating apparatus is located at a single joint, it is critical that the joint be well lubricated. Accordingly, provision is made for grease or other lubrication to fill the reservoir space 68 within the plunger pin attachment end 36 of the rotary arm 30. This space 68 is covered by an outboard cover plate 70, which along with the spherical bearing 64 and bearing housing 66, serve to capture any lubricant within the reservoir space 68. As the joint is sealed to the outboard side by the cover 70, centrifugal force will tend to retain any grease or lubricant within the reservoir 68, with the spherical bearing 64 wiping lubricant into the housing 66 as the assembly rotates, and the outboard end 62 of the plunger pin 58 being lubricated by its reciprocating or sliding action within the spherical bearing 64 during operation. A lubrication fitting 72*a* may be provided for the lubrication of the joint, if desired, and in a like manner, a lubrication fitting 72*b* may be provided for the speed reduction drive 20 within the output shaft housing 22. A sealed or otherwise lubricated bearing means (e.g., ball bearing 74) may be provided for the output shaft 18 within the output shaft housing 22 and adjacent the reduction drive 20.

The present pump 10 is intended to be used with existing hydraulic devices, particularly portable and/or otherwise manually powered hydraulic rams, e.g., hydraulic floor and bottle jacks, presses, lifts, wood splitting and other cutting devices, etc. As such, it is important that the valve means used for the control of hydraulic or other fluid be adaptable to such devices. Normally, such devices are equipped with manually operated valves to provide for the capture or release of pressurized fluid. However, other means must be provided for supply of fluid to the device.

Accordingly, the present pump 10 may include a valve cartridge 76 which is installable as a replacement for the standard hydraulic master cylinder and/or valving associated therewith, in cartridge form. FIG. 1 discloses a cartridge 76*a*, in which the relief valve is ported downstream of the output valve, while FIG. 2 discloses a cartridge 76*b* in which the relief valve is ported upstream of the output valve. The differences between the two cartridges 76*a* and 76*b* will be discussed separately below. The valve cartridge 76*a*/76*b* is removably installable within the housing H of a hydraulic device, and provides for output and pressure relief of pressurized fluid supplied by the plunger 52 and plunger body cylinder 50. The plunger body 38 includes a threaded lower outer surface 78, which provides for the threaded attachment of the present pump 10 to the housing H of a hydraulic device in order to provide for the automated operation thereof.

The original hydraulic pressure delivery means is removed from the hydraulic device, the present valve cartridge 76*a*/76*b* is inserted into the housing H, and the plunger body 38 of the present pump 10 is threaded into the housing H to capture the valve cartridge 76*a*/76*b* therein and secure the assembly together. The valve cartridge 76*a*/76*b* is accordingly preferably cylindrical and may include opposite beveled edges 80*a* and 80*b* at its two opposite ends. These bevels 80*a* and 80*b* provide space between the housing, the lower or fluid control end 82 of the plunger body 38, and the housing H, for the capture of O-rings 84*a* and 84*b* respectively therein to provide for the sealing of the valve cartridge 76*a*/76*b* within the housing H and relative to the plunger body 38, as the valve cartridge 76*a*/76*b* is captured within the housing H by the plunger body 38.

The valve cartridge 76*a*/76*b* provides internal valving for the inflow, outflow, and pressure relief of fluid transferred by the present pump 10. In FIG. 1, the cartridge 76*a* includes an inlet valve 86*a*, an outlet valve 88*a*, and a pressure relief valve 90*a*. The cartridges 76*a*/76*b* each respectively include a circumferential fluid flow groove or passage 92*a*/92*b*, allowing fluid to flow to the inlet/relief valves 86*a*/86*b* and 90*a*/90*b* regardless of the orientation of the cartridge 76*a*/76*b* within the housing H. Similarly, a conic widening or relief 94 of the fluid output end 82 of the plunger body 38 provides for fluid flow from the cylinder bore 50 to and from the radially displaced inlet valve 86*a*/86*b* and outlet valve ducts 96*a*/96*b*, without any requirement for precise alignment of the cartridge 76*a*/76*b* within the housing H or relative to the threaded installation of the plunger body 38 within the housing H.

In both the valve cartridges 76*a* and 76*b*, the inlet valves 86*a*/86*b* extend radially from the pressure relief valve passages 98*a*/98*b* and downstream of the pressure relief valves 90*a* and 90*b*. As the inlet ducts for the inlet valves 86*a*/86*b* are each downstream of the actual pressure relief valves 90*a*/90*b* and merely draw fluid from the outlet side of those relief valves, the inlets will be under normal fluid pressure and will thus operate normally. As the plunger 52 is drawn upward within the cylinder 50, the higher pressure within the fluid pressure passage(s) 98*a*/98*b* relative to the lower cylinder 50 pressure will force the inlet ball check valve 86*a* (or the conical needle type valve 86*b*) away from the valve seat 100*a*/100*b*, against the pressure of the spring 102*a*/102*b*. Fluid will then flow past the valve seat 100*a*/100*b*, through the axially offset fluid passages 104*a*/104*b*, and through the central inlet valve retainer orifice 106*a*/106*b* to enter the cylinder 50.

The outlet valves 88*a* and 88*b* operate in a similar manner, with the outlet valve 88*a* being a ball check type valve and the outlet valve 88*b* a conical tip or needle valve. (It will be understood that either type of valve may be used in any of the configurations of the valve cartridges 76 of the present pump 10.) As the plunger 52 descends within the cylinder bore 50, any fluid contained therein will be forced under pressure through the outlet valve duct(s) 96*a*/96*b*. When the pressure is sufficiently high to overcome both the resistance of the outlet valve spring 106*a*/106*b* and any working pressure developed within the hydraulic device being operated (and thus reflected back to the outlet port P of the housing H), the outlet valve 88*a*/88*b* will be forced away from its seat 108*a*/108*b*, and fluid will flow from the outlet duct 96*a*/96*b*, past the outlet valve seat, through the axially displaced fluid passages 110*a*/110*b*, and out the outlet valve retainer passage 112*a*/112*b* through the outlet port P of the housing H.

In the event that working pressure builds to the limits of the present pump 10, a pressure relief valve(s) 90*a*/90*b* is provided respectively for each of the cartridges 76*a*/76*b*. It will be seen that, as the outlet valve(s) 88*a*/88*b* open during the downstroke of the plunger 52, the pressure within the outlet valve passage 96*a*/96*b* will be essentially equal to the working pressure within the hydraulic device being operated (excepting any momentary dynamic transients). Accordingly, the relief valve(s) 90*a*/90*b* may be interconnected to the outlet valve passage either downstream of the valve (as in the valve 88*a* of FIG. 1) or upstream of the valve, to the outlet duct 96*b* (as in FIG. 2). In either case, the components for the outlet valves 88*a*/88*b* are similar, with the respective exception of the ball check and conical type valves.

Normally, the pressure relief valve spring 114*a*/114*b* will be considerably stronger than the inlet and outlet valve springs 102*a*/102*b* and 106*a*/106*b* discussed above; the pressure relief valve springs 114*a*/114*b* must provide a closing force equal to the intended working pressure limits of the pump 10 and/or the hydraulic device being operated by the pump 10. Otherwise, the ball check pressure relief valve 90*a* (FIG. 1) and the conical or needle type pressure relief valve 90*b* (FIG. 2) operate similarly to the other axially opening inlet and outlet valves 86*a*/86*b* and 88*a*/88*b* discussed above. When sufficient pressure is reached, the relief spring(s) 114*a*/114*b* is compressed, and the valve 90*a*/90*b* is forced away from its seat 116*a*/116*b*. Fluid then flows thorough the appropriate passages and the axially displaced fluid passage(s) 118*a*/118*b*, thence through the pressure relief valve passages 98*a*/98*b* and outward through the axially displaced valve retainer fluid passages 120*a*/120*b* to the fluid reservoir or supply. As the working pressure drops, the pressure relief spring(s) 114*a*/114*b* force the pressure relief valve(s) 90*a*/90*b* closed, whereupon the inlet valve(s) 86*a*/86*b* may operate to draw fluid from the combination pressure relief valve and inlet valve passage(s) 98*a*/98*b*, as discussed above.

As the pressure relief valve(s) normally operate at relatively high pressures, they may be equipped with peripheral O-ring(s) 122*a*/122*b* in order to provide better sealing and to reduce "chatter" and maintain stability of the valve(s) 90*a*/90*b* during operation. Also, at least the pressure relief valve(s) 90*a*/90*b* are adjustable, by means of the valve retainer being threaded into the relief valve passage(s) 98*a*/98*b* for the advancement or retraction thereof. A slot 124*a*/124*b* may be provided for adjustment.

As noted above, normally the present pump 10 is powered by a hydraulic, electric or pneumatic motor 12 for ease of operation. However, in the event of a power or motor failure, or if a suitable power source is not available, the present pump 10 may also be manually operated. Preferably, the motor 12 is quickly and easily removable from and installable on the output shaft housing 22, by means of the threaded attachment 126. The motor 12 may be unscrewed or otherwise removed from the output shaft housing 22, thus also withdrawing the motor drive shaft 16 from the housing 22. The plate 128 upon which the planetary gear set 24 is mounted, includes a slot or other receptacle 130 at its center, which receptacle 130 is exposed when the motor 12 and its accompanying drive shaft 16 are removed from the housing 22. A hand crank 14 (FIG. 4) including a cooperating blade or other fitting 132, may be provided for manual operation of the present pump 10. By inserting the blade 132 into the slot 130, the operator of the present pump 10 may manually operate the pump 10 and any hydraulic device to which it is connected, without need for other power sources or motorized means. The pump 10 operates similarly whether manually powered or motorized, with the direction of rotation having no effect upon the direction of inlet or outlet flow. Other devices (e.g., power screwdriver) may also be used for power.

When pump 10 is motorized, the rpm will generally be higher than that achieved by manual operation, preferably on the order of 300 to 800 rpm in order to provide optimum speed for plunger 52 operation with the valve sizes provided within the unitary valve cartridge 76*a*/76*b*. Accordingly, a guard or shroud 134 may be provided over the rotary arm 30, plunger pin 58, and their common joint, for the protection of persons using the present pump 10.

In summary, the present hydraulic pump 10 will be seen to provide numerous advantages in the shop or other environment where hydraulic tools and equipment are used. The simple removal of existing generally manually operated hydraulic supply means from such devices, and the installation of the present pump 10 therefor, alleviates much of the workload involved with the operation of such devices. In the event that the valve cartridge of the present pump is not adaptable to the hydraulic device to be powered by the present pump 10, the cartridge is easily removable from the remainder of the pump as it is not directly attached to any component of the pump but is disposed adjacent to and communicates with the plunger body of the present pump. Thus, the present pump is seen to be adaptable to a wide range of hydraulic equipment.

The present pump is intended to be powered by a wide variety of sources. When electric, pneumatic, or hydraulic power is not available, or the pump motor is inoperable, the motor may be easily removed to expose a fitting in the drive mechanism for manual operation by a hand crank or the like. Alternatively, other power means (electric screwdriver, etc.) may be used to power the pump.

The mechanical means for converting rotary motion to reciprocal motion to drive the pump plunger, eliminates all moving joints between rotary drive and plunger, except one, to provide a relatively rugged construction. The single relatively movable joint provides both rotary and longitudinal motion for the joint components, to provide compliance for all relative motion of the moving parts of the present pump.

It is to be understood that the present invention is not limited to the sole embodiment described above, but encompasses any and all embodiments within the scope of the following claims.

I claim:

1. A hydraulic pump providing unidirectional hydraulic fluid flow and capable of being powered by a rotary power source and providing output to various hydraulic devices, said pump comprising:

rotary power means driving a rotary output shaft having a rotary axis;

a rotary arm having a rotary axis output shaft attachment end and an opposite plunger pin attachment end, with said rotary output shaft being fixedly connected to said output shaft attachment end of said rotary arm;

a plunger pin having a plunger attachment end and an opposite rotary arm attachment end, with said plunger pin attachment end of said rotary arm including bearing means thereon providing movable connection between said plunger pin attachment end of said rotary arm and said rotary arm attachment end of said plunger pin;

a reciprocating plunger having a fluid working end, an opposite plunger pin attachment end, and a reciprocating axis, with said plunger pin attachment end of said plunger being fixedly attached to said plunger attachment end of said plunger pin at a right angle thereto;

said plunger reciprocating within a cylinder within a plunger body, with said plunger body having a fluid control end communicating with said fluid working end of said plunger, and an opposite rotary power means attachment end;

said rotary power means removably cooperating with an output shaft housing, with said output shaft housing being supported by at least two oppositely spaced apart and angularly displaced output shaft housing support arms, with said support arms each having an output shaft housing attachment end and an opposite plunger body attachment end, with each said output shaft housing attachment end of said support arms being fixedly connected to said output shaft housing and each said plunger body attachment end of said support arms being fixedly connected to said plunger body, with said support arms thereby providing an angular displacement between said rotary axis and said reciprocating axis of said pump, whereby;

rotation of said output shaft by said rotary power means causes said rotary arm to rotate about said rotary axis and thereby cause said plunger pin and said plunger to rotate and reciprocate relative to said plunger body by means of said angular displacement between said rotary axis and said reciprocating axis of said pump, thereby producing hydraulic fluid flow by means of reciprocation of said plunger.

2. The unidirectional hydraulic pump of claim 1 wherein:

said rotary power means is motorized.

3. The unidirectional hydraulic pump of claim 2 wherein:

said rotary power means comprises an electric motor.

4. The unidirectional hydraulic pump of claim 2 wherein:

said rotary power means comprises a pneumatic motor.

5. The unidirectional hydraulic pump of claim 2 wherein:

said rotary power means comprises a hydraulic motor.

6. The unidirectional hydraulic pump of claim 1 wherein:

said rotary power means comprises a hand crank.

7. The unidirectional hydraulic pump of claim 1 wherein:

said hydraulic pump includes a removable and replaceable valve cartridge cooperating with said fluid control end of said plunger body;

said valve cartridge including at least an inlet valve passage, an outlet valve passage, and a relief valve passage formed therein, with each said passage respectively including an inlet valve, an outlet valve, and a relief valve installed therein, and;

each said valve passage including a valve seat therein and each said valve including sealing means cooperating respectively with each said valve seat.

8. The unidirectional hydraulic pump of claim 7 wherein:

said valve cartridge comprises a generally cylindrical shape having beveled ends thereon, with each of said beveled ends of said valve cartridge and said fluid control end of said plunger body defining a sealing space therebetween, with each said sealing space including an O-ring therein providing for the sealing of said valve cartridge within said plunger body.

9. The unidirectional hydraulic pump of claim 7 wherein:

each said valve operates axially respectively within each said passage arid each said valve includes at least one openable fluid passage therethrough, whereby hydraulic fluid flows through said at least one fluid passage of said valve when said sealing means of said valve is axially displaced respectively from said valve seat.

10. The unidirectional hydraulic pump of claim 7 wherein:

each said valve is adapted to provide a closely cooperating fit respectively within each said valve passage, and at least one said valve includes a periphery having an O-ring installed therearound with each said O-ring providing a seal respectively between said at least one said valve periphery and said valve passage to preclude peripheral passage of hydraulic fluid, whereby valve chatter is reduced and valve stability is provided.

11. The unidirectional hydraulic pump of claim 7 wherein:

said relief valve passage includes said inlet valve passage extending radially therefrom, whereby hydraulic fluid flows through said relief valve passage and thence radially from said relief valve passage through said inlet valve passage to said cylinder.

12. The unidirectional hydraulic pump of claim 7 wherein:

said valve cartridge includes an intermediate duct extending from said cylinder to said outlet valve passage, with said intermediate duct including a radial passage extending therefrom and cooperating with said relief valve passage, whereby hydraulic fluid flows from said intermediate duct to said relief valve passage without entering said outlet valve when said relief valve is open.

13. The unidirectional hydraulic pump of claim 7 wherein: said outlet valve includes a radial passage extending therefrom and cooperating with said relief valve passage, whereby hydraulic fluid flows from said outlet valve passage to said relief valve passage when both said outlet valve and said relief valve are open.

14. The unidirectional hydraulic pump of claim 7 wherein:

at least said relief valve sealing means comprises a check ball.

15. The unidirectional hydraulic pump of claim 7 wherein:

at least said relief valve sealing means comprises a needle formed integrally with said relief valve.

16. The unidirectional hydraulic pump of claim 1 including:

speed reduction means disposed within said output shaft housing, with said speed reduction means serving to reduce the rotary speed of said rotary output shaft relative to said rotary power means.

17. The unidirectional hydraulic pump of claim 16 wherein:

said speed reduction means comprises a planetary gear reduction.

18. The unidirectional hydraulic pump of claim 1 wherein:

said bearing means providing movable connection between said plunger pin attachment end of said rotary arm and said rotary arm attachment end of said plunger pin comprises a spherical bearing providing for rotational movement of said rotary arm relative to said plunger pin, and further providing for linear movement of said plunger pin attachment end of said rotary arm along said rotary arm attachment end of said plunger pin.

19. The unidirectional hydraulic pump of claim 18 wherein:

said bearing means includes an enclosed outboard side, whereby centrifugal disposal of lubrication from said bearing means is precluded.

20. The unidirectional hydraulic pump of claim 19 wherein:

said bearing means includes a lubrication fitting therein.

21. A hydraulic pump providing unidirectional hydraulic fluid flow and capable of being powered by a rotary power source and providing output to various hydraulic devices, said pump comprising:

rotary power means driving a rotary output shaft having a rotary axis;

rotary arm having a rotary axis output shaft attachment end and an opposite plunger pin attachment end, with said rotary output shaft being fixedly connected to said output shaft attachment end of said rotary arm;

a plunger pin having a plunger attachment end and an opposite rotary arm attachment end, with said plunger pin attachment end of said rotary arm including bearing means thereon providing movable connection between said plunger pin attachment end of said rotary arm and said rotary arm attachment end of said plunger pin;

a reciprocating plunger having a fluid working end, an opposite plunger pin attachment end, and a reciprocating axis, with said plunger pin attachment end of said plunger being fixedly attached to said plunger attachment end of said plunger pin at a right angle thereto;

said plunger reciprocating within a cylinder within a plunger body, with said plunger body having a fluid control end communicating with said fluid working end of said plunger, and an opposite rotary power means attachment end;

a removable and replaceable valve cartridge cooperating with said fluid control end of said plunger body;

said valve cartridge including at least an inlet valve passage, an outlet valve passage, and a relief valve passage formed therein, with each said passage respectively including an inlet valve, an outlet valve, and a relief valve installed therein;

each said valve passage including a valve seat therein and each said valve including sealing means cooperating respectively with each said valve seat;

said rotary power means removably cooperating with an output shaft housing, with said output shaft housing being supported by at least two oppositely spaced apart and angularly displaced output shaft housing support arms, with said support arms each having an output shaft housing attachment end and an opposite plunger body attachment end, with each said output shaft housing attachment end of said support arms being fixedly connected to said output shaft housing and each said plunger body attachment end of said support arms being fixedly connected to said plunger body, with said support arms thereby providing an angular displacement between said rotary axis and said reciprocating axis of said pump, whereby;

rotation of said output shaft by said rotary power means causes said rotary arm to rotate about said rotary axis and thereby cause said plunger pin and said plunger to rotate and reciprocate relative to said plunger body by means of said angular displacement between said rotary axis and said reciprocating axis of said pump, thereby producing hydraulic fluid flow by means of reciprocation of said plunger and control of the hydraulic fluid flow by means of said valve cartridge cooperating with said fluid control end of said plunger body.

* * * * *